US009276355B2

(12) United States Patent
Laurent et al.

(10) Patent No.: US 9,276,355 B2
(45) Date of Patent: Mar. 1, 2016

(54) HIGH VOLTAGE PLUG IN AND UNPLUGGED TYPE GAS IMMERSED CABLE TERMINATION WITH LOCKING SYSTEM

(71) Applicants: Michel Pierre Laurent, Hong Kong (HK); Ha Ming Wong, Hong Kong (HK)

(72) Inventors: Michel Pierre Laurent, Hong Kong (HK); Ha Ming Wong, Hong Kong (HK)

( * ) Notice: Subject to any disclaimer, the term of this patent is extended or adjusted under 35 U.S.C. 154(b) by 19 days.

(21) Appl. No.: 14/303,597

(22) Filed: Jun. 13, 2014

(65) Prior Publication Data

US 2014/0370736 A1 Dec. 18, 2014

Related U.S. Application Data

(60) Provisional application No. 61/834,433, filed on Jun. 13, 2013.

(51) Int. Cl.

| | |
|---|---|
| ***H01R 4/50*** | (2006.01) |
| ***H01R 13/627*** | (2006.01) |
| ***H01R 13/53*** | (2006.01) |
| *H01R 101/00* | (2006.01) |

(52) U.S. Cl.

CPC ..... *H01R 13/6278* (2013.01); *H01R 13/53* (2013.01); *H01R 2101/00* (2013.01); *Y10T 29/49208* (2015.01)

(58) Field of Classification Search

CPC ..... H01R 13/53; H01R 13/6278; H01R 2101/00; Y10T 29/49208

USPC ..... 439/345, 347, 352, 700

See application file for complete search history.

(56) References Cited

U.S. PATENT DOCUMENTS

| | | | | |
|---|---|---|---|---|
| 4,029,380 A * | 6/1977 | Yonkers | H01H 9/085 174/72 R |
| 5,427,538 A * | 6/1995 | Knapp | H01R 13/53 439/157 |
| 6,364,216 B1 * | 4/2002 | Martin | H01R 13/53 439/181 |
| 8,449,310 B2 * | 5/2013 | Siebens | H01R 13/53 439/181 |

FOREIGN PATENT DOCUMENTS

| | | |
|---|---|---|
| CN | 202050172 | 11/2011 |

* cited by examiner

*Primary Examiner* — Khiem Nguyen

(74) *Attorney, Agent, or Firm* — Eagle IP Limited; Jacqueline C. Lui

(57) ABSTRACT

A high voltage plug-in and unplugged type gas immersed cable termination comprising a recess inside the blind end of the electrode to allow the extension of the locking pin to lock the connector with the electrode and thereby anchor the power cable. The locking pin is designed to anchor the power cable to safeguard against sliding down of the power cable during the operation period. The high voltage plug-in and unplugged type gas immersed cable termination can be unplugged manually. The locking pin can be replaced before re-plugging-in of the termination.

13 Claims, 8 Drawing Sheets

HIGH VOLTAGE PLUG IN AND UNPLUGGED TYPE GAS IMMERSED CABLE TERMINATION WITH LOCKING SYSTEM

CROSS REFERENCE TO RELATED APPLICATIONS

This application claims the priority of U.S. provisional Application No. 61/834,433 filed Jun. 13, 2013, the whole of which is hereby incorporated by reference herein

FIELD OF INVENTION

The present invention is related to a system for positioning a power cable and in particular to a system which carries a locking device to position the power cable and safeguard it from sliding down.

BACKGROUND OF INVENTION

In the operation of high voltage equipment, the control of the electric field according to the physical positioning of the power cable is very essential. Movement of the power cable inside a termination may affect the electric field distribution, which will in turn affect the life of the cable termination and may even lead to the failure of the power supply system.

The mainstream technique at the current stage of suspending the power cable inside a high voltage plug-in and unplugged type gas immersed cable termination is to depend on the friction of the power cable with the outer layers. However, with large conductors, the heavy weight of the core increases the risk of its falling down.

For power cable with corrugated aluminium sheath, the friction between the core and the metallic sheath is rather low. There are cases of loosening due to poor manufacturing of cable cores for the corrugated aluminium sheath cable. In this respect, the suspension of the power cable by friction becomes ineffective. Such corrugated aluminum sheath cable is commonly used inside substations where vibration of the transformer under load exists.

SUMMARY OF INVENTION

In the light of the foregoing background, it is an object of the present invention to develop a system which carries a locking device to position the power cable and safeguard it from sliding down with high reliability during operating condition. Particularly, the advantage of the system of the present invention includes preventing the power cable from slide down during all circumstances of operating conditions and/or due to heavy weight of conductor and insulation loadings.

Accordingly, the present invention, in one aspect, provides a system for positioning a power cable comprising a connector, wherein the connector comprising a housing comprising a cable end and an opposing engagement end defining an insertion axis there between; a cable cavity disposed on the cable end and configured to receive the power cable; an actuator placed at the housing at the engagement end and movable along the insertion axis towards the cable end; the actuator movable between a pre-engagement position and an engagement position; at least one locking pin provided within the housing and movable along an engagement axis axial to the insertion axis; the locking pin engaged to the actuator and movable from an unlocked to a locked position. When the actuator in the pre-engagement position provides a space for the locking pin to stay in the unlocked position. When the actuator in the engagement position pushes the locking pin into the locked position and is anchored by the locking pin such that the power cable is electrically connected to the electrode.

In an exemplary embodiment of the present invention, wherein the connector further comprises a locking pin cavity positioned along the engagement axis, wherein the locking pin cavity further comprises a locking pin stopper and a locking pin spring disposed around the locking pin, and wherein the locking pin is movably disposed within the locking pin cavity, and when the locking pin is at the second locked position at least a portion of the locking pin is extended out of the locking pin cavity.

In an exemplary embodiment of the present invention, wherein the locking pin stopper further comprises a hollow threaded screw unit.

In an exemplary embodiment of the present invention, wherein the locking pin stopper is configured to fix the locking pin on the insertion axis.

In an exemplary embodiment of the present invention, wherein the actuator is a mandril.

In an exemplary embodiment of the present invention, wherein the mandril has a head and a narrower tail.

In an exemplary embodiment of the present invention, wherein the connector further comprises a mandril cavity positioned along the insertion axis, wherein the mandril is movably disposed within the mandril cavity and is configured to push the locking pin at one end thereof.

In an exemplary embodiment of the present invention, wherein the mandril cavity further comprises a mandril spring disposed at one end of the mandril cavity and a plurality of mandril stoppers at the other end of the mandril cavity, wherein the mandril is deposited between the mandril spring and the plurality of mandril stopper while at least a portion of mandril is extended outside the mandril cavity.

In an exemplary embodiment of the present invention, wherein the mandril further comprises an intermediate portion disposed between the head and the narrower tail of the mandril; and a fringe extended outwardly from the head of the mandril and disposed between the head and the intermediate portion, wherein the intermediate portion comprises an inclined surface connecting between the narrower tail and the fringe, when at the engagement position, the inclined surface is configured to push the locking pin into the locked position and the fringe is anchored by the one end of the locking pin such that the mandril is held at the engagement position and the locking pin is held at the locked position.

In an exemplary embodiment of the present invention, wherein the mandril further comprises a fringe extended outwardly configured to be captured by the plurality of mandril stoppers when the mandril is at the pre-engagement position.

In an exemplary embodiment of the present invention, wherein the connector has recesses on its cylindrical exterior.

In an exemplary embodiment of the present invention, wherein the system further comprises an electrode, which comprises a recess positioned near the blind end of the electrode, wherein at least a portion of the electrode is covered by an epoxy resin insulating cone.

In an exemplary embodiment of the present invention, wherein the locking pin is made of aluminum alloy.

In a further aspect of the present invention, wherein a method of locking a power cable to an electrode is provided, comprising the step of providing a connector comprising a housing, an actuator and a locking pin; plugging the connector into the electrode till the actuator is at a engagement position thereby actuates the locking pin to fix the connector such that the power cable is electrically connected to the electrode.

In an exemplary embodiment of the present invention, wherein the actuator further comprises a mandril, and the locking pin is actuated by being pushed away from an unlocked position to a locked position by the mandril, which is pushed against the electrode.

In an exemplary embodiment of the present invention, wherein the method further comprises a step of attaching the locking pin to an interior wall of the electrode.

In one embodiment, the system is a high voltage plug-in and unplugged type gas immersed cable termination.

Accordingly, the present invention provides a high voltage plug-in and unplugged type gas immersed cable termination comprising of a locking system which is independent of the friction between layers of power cables.

Accordingly, the present invention provides a high voltage plug-in and unplugged type gas immersed cable termination that can be unplugged without the necessity of disturbing any major components of the cable termination. To facilitate the plug-in and unplugged function, it is possible to remove the power cable manually without disturbing of the rest of the major components of the cable termination.

BRIEF DESCRIPTION OF FIGURES

For a complete understanding of the present invention, reference is made to the following detailed description and accompanying drawings, in which.

DETAILED DESCRIPTION OF THE PREFERRED EMBODIMENTS

As used herein and in the claims, "comprising" means including the following elements but not excluding others. As used herein and in the claims, "comprising" means including the following elements but not excluding others.

As used herein and in the claims, "couple" or "connect" refers to electrical coupling or connection either directly or indirectly via one or more electrical means unless otherwise stated.

Figure 1:
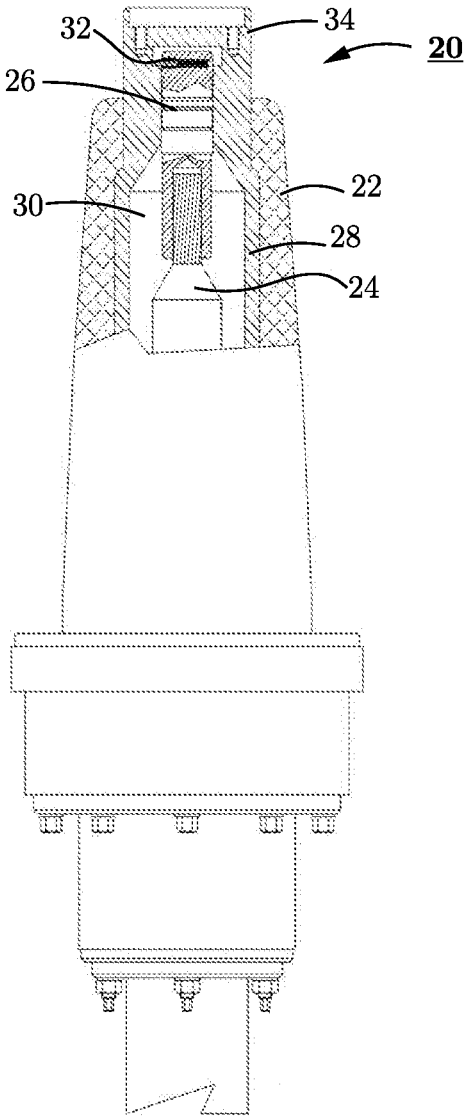
FIG. 1 is a schematic view of the high voltage plug-in and unplugged type gas immersed cable termination with the connector according to the first embodiment of the present invention.

For a more complete understanding of the present invention, reference is made to the following detailed description:

Referring to FIG. 1, the high voltage plug-in and unplugged type gas immersed cable termination 20 includes an epoxy resin insulating cone 22, a power cable 24, a connector 26, and a high voltage (HV) electrode 28. The HV electrode 28 is partially covered by the epoxy resin insulating cone 22. Particularly, the upper end of the HV electrode 28 is not covered by the epoxy resin insulating cone 22 (uncovered portion 34), only the lower end of the HV electrode 28 is covered (covered portion). The HV electrode 28 is in substantially cylindrical shape and includes a hollow portion 30. The hollow portion 30 of the HV electrode 28 is configured to receive the connector 26. The inner wall 32 of the HV electrode 28 is substantially flat/smooth and does not contain any groove. Under the epoxy resin insulating cone 22, the power cable 24 is connected to the connector 26. Thereby, the HV electrode 28 is in electrical connectivity with the power cable 24 through the connector 26. The connector 26 includes a housing for holding all the elements of the connector 26. The housing includes a cable end and an opposing engagement end defining an insertion axis there between. The connector 26 includes a cable cavity 58 at the cable end 60 for receiving and connecting the power cable 24.

Figure 2:
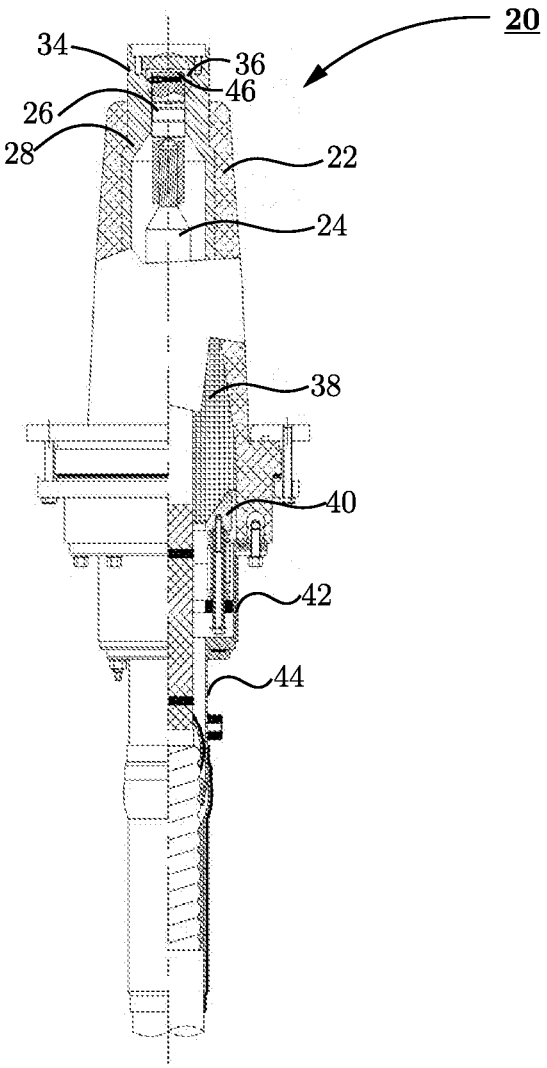
FIG. 2 is a cross-sectional view of the high voltage plug-in and unplugged type gas immersed cable termination with the connector according to the first embodiment of the present invention.

As shown in FIG. 2, the cable termination 20 further comprises a stress cone 38, a compression unit 40, a compression housing 42 and a cable gland 44. The stress cone 38 is tightly compressed against the epoxy resin insulating cone 22 by the compression unit 40 enclosed in the compression housing 42. There is an interface surface between the stress cone 38 and the epoxy resin insulating cone 22. To prevent the creepage of electricity along the interface surface, it is necessary to compress the stress cone 38 tightly against the epoxy resin insulating cone 22. The power cable 24 finally comes out of the high voltage plug-in and unplugged type gas immersed cable termination 20 through the cable gland 44. The stress cone 38 is made of polymeric materials, which is a component made of insulating and electrical semi-conducting material. The HV electrode 28 further includes a recess 36 located between the hollow portion 30 of the HV electrode 28 and the uncovered portion 34 of the HV electrode 28 to receive the head portion 46 of the connector 26.

Figure 3:
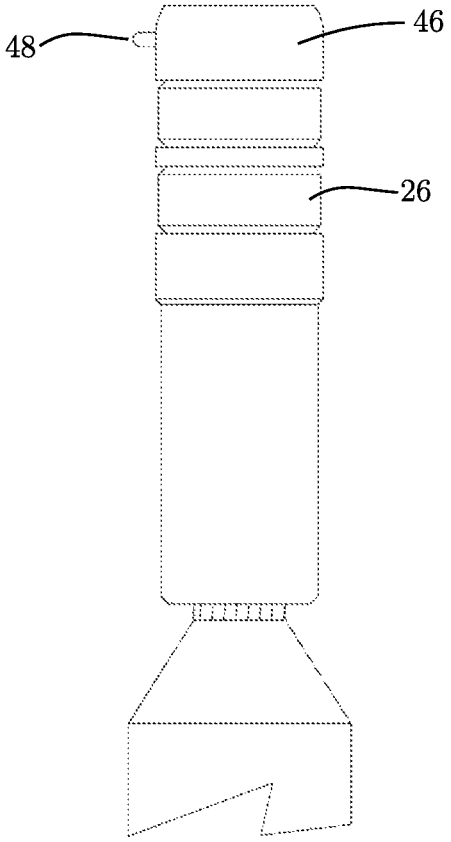
FIG. 3 is a schematic view of the connector with the locking pin according to the first embodiment of the present invention.
Figure 4:
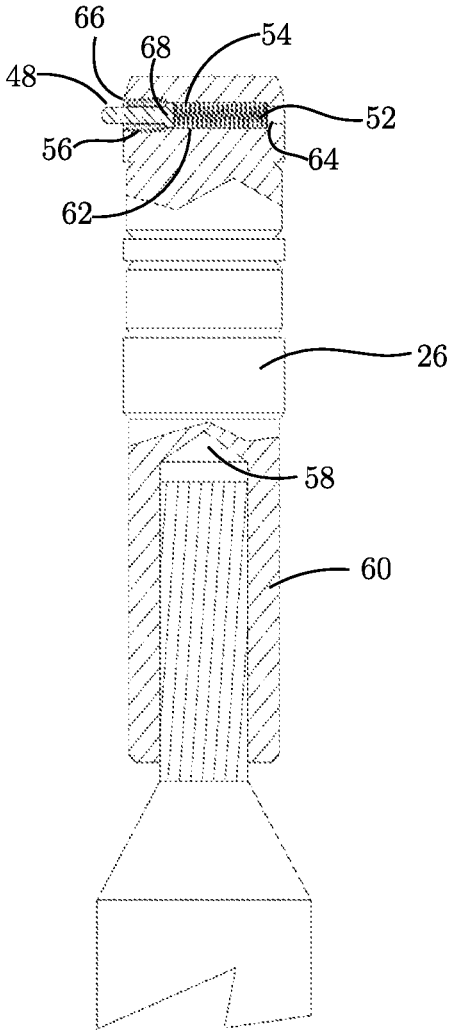
FIG. 4 is a cross-sectional view of the connector with the locking pin according to the first embodiment of the present invention.

FIG. 3 and FIG. 4 show a schematic view and a cross section view of the connector 26 with a locking pin 48 selectively projected from it. As shown in FIG. 3, the connector 26 includes a locking pin 48 disposed at the head portion 46. The locking pin 48 is selectively movable from an unlocked position and a locked position. At least a portion of the locking pin 48 is projected from the connector 26 when it is at the locked position. The locking pin 48 is made of aluminum. The connector 26 is substantially in cylindrical shape. The surface of the connector 26 has a plurality of recesses 50. The connector 26 further comprises a plurality of multi contact rings placed around the surface of the connector 26 and configured to facilitate the transfer of electricity at high power. Each of the multi contact rings comprises a pair of legs at its side edges, which is inserted into the recesses 50 and a flexible cushion disposed on its surface between the side edges. A clamping ring is further disposed at each of the recesses 50 and on each of the legs of the multi contact ring for fixing the multi contact ring on the surface of the connector 26. The radius of the multi contact ring at the flexible cushion portion is slightly larger than the radius of the connector 26. When the connector 26 is inserted into the HV electrode 28, the flexible cushion is compressed by the wall of the HV electrode 28 and the surface wall of the connector 26, thereby an electric connection between the connector 26 and the HV electrode 28 is secured through the multi contact rings. With the plurality of multi contact rings used over the recesses 50, the cable termination 20 can transfer electricity at 3700 A or more from the power cable 24 to the HV electrode 28 through the connector 26. The multi contact rings also ensure a good conductivity or to allow a smooth current flow. As shown in FIG. 4, the connector 26 includes a cavity 58 at the tail end 60 for receiving and connecting the power cable 24. At the head portion 46 of the connector 26, a locking pin cavity 54 is formed. The locking pin cavity 54 is positioned along an engagement axis that is perpendicularly to the insertion axis of the connector 26. Inside the locking pin cavity 54 includes the locking pin 48, a locking pin stopper 56 and a locking pin spring 52. The locking pin stopper 56 is a hollow threaded screw unit. The locking pin cavity 54 has two portions. The first portion 62 of the locking pin cavity 54 has a diameter to fitly accommodate the locking pin spring 52, the locking pin 48 and the locking pin stopper 56, while the second portion 64 has a diameter smaller than the first portion 62. The locking pin stopper 56 is installed in the opening end 66 at the connector's surface while the locking pin spring 52 is installed at the other end of the first portion that is next to the second portion 64. The locking pin 48 includes a pin with an enlarged head 68 at one end. The diameter of the enlarged head 68 is substantially larger than the diameter of the locking pin stopper 56 such that when the locking pin 48 is installed between the locking pin stopper 56 and the locking pin spring 52 with the enlarged head 68 facing the locking pin spring 52, only a portion of the pin is extended out of the connector 26 as the enlarged head 68 of the locking pin 48 is blocked by the locking pin stopper 56 when the locking pin spring 52 pushes the locking pin 48 away from the locking pin cavity 54. The first portion 62 has a length to hold the whole length of the locking pin 48 when it is retracted into the locking pin cavity 54 by external force. The diameter of the projected end of the locking pin 48 is 3.8±0.05 mm while the diameter of the enlarged head 68 of the locking pin 48 is 5.6±0.05 mm.

Figure 5:
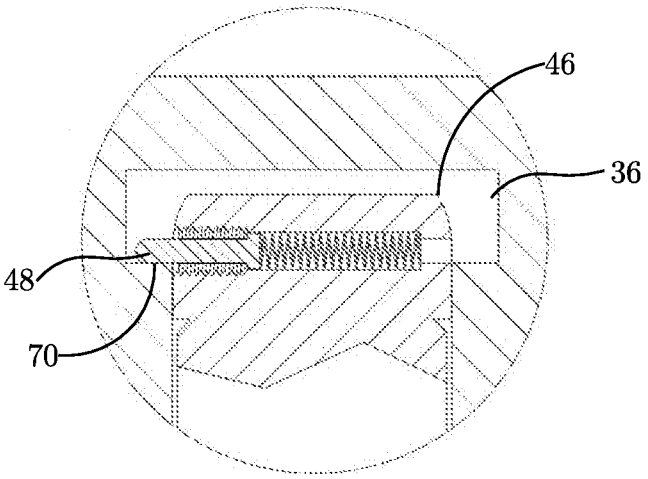
FIG. 5 is a cross-sectional view of the connector installed inside the epoxy cone with the locking pin according to the first embodiment of the present invention.

In FIG. 5, the recess 36 is configured to receive the head portion 46 of the connector 26 with the locking pin 48. In operation, the connector 26 is inserted into the hollow portion 30 of the HV electrode 28. The connector 26 is optionally connected to the power cable 24 at the tail end 60 during the insertion. As the head portion 46 of the connector 26 with the locking pin 48 reaches the recess 36, the locking pin 48 will be moved from the connector 26 towards the recess 36 thereby attaches to a wall 70 of the recess 36, which is adjacent to the extended portion of the locking pin 48. Thus, the position of the power cable 24 is fixed. It can be seen that the end of the locking pin 48 is enlarged to ensure that it holds the power cable 24 tightly.

Figure 6:
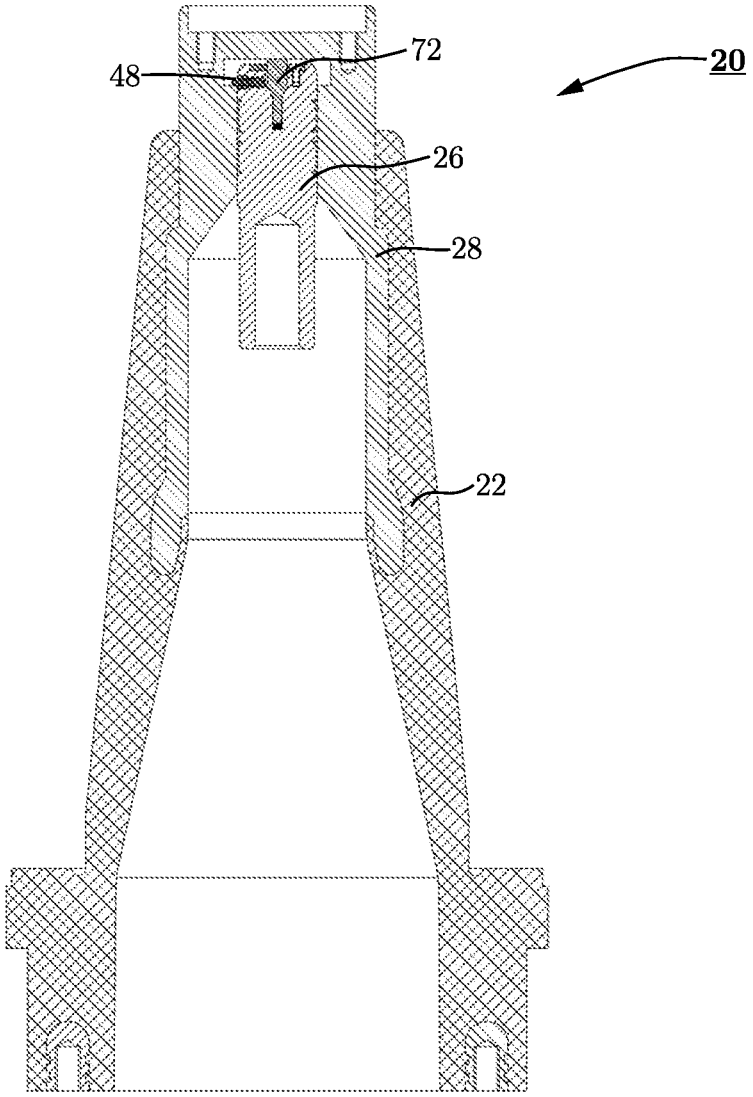
FIG. 6 is a cross-sectional view of the high voltage plug-in and unplugged type gas immersed cable termination with the connector at plugged in position according to the second embodiment of the present invention.

FIG. 6 shows the high voltage plug-in and unplugged type gas immersed cable termination 20 includes the epoxy resin insulating cone 22 as the housing, a connector 26 according to the second embodiment of the present invention, and the HV electrode 28. The connector 26 according to the second embodiment includes a mandril 72 in order to act as sensing device/actuator and a locking pin 48. The mandril 72 is placed at the engagement end of the housing of the connector 26 and movable along the insertion axis towards the cable end between a pre-engagement position and an engagement position. The mandril 72 has a head and a narrower tail with an intermediate portion of inclined surface therebetween. The epoxy resin insulating cone 22 and the HV electrode 28 are the same as disclosed in above. The inner wall 32 of the HV electrode 28 is substantially flat/smooth and does not contain any groove. The connector 26 also includes a housing for holding all the elements of the connector 26. The housing includes a cable end and an opposing engagement end defining an insertion axis therebetween.

Figure 7:
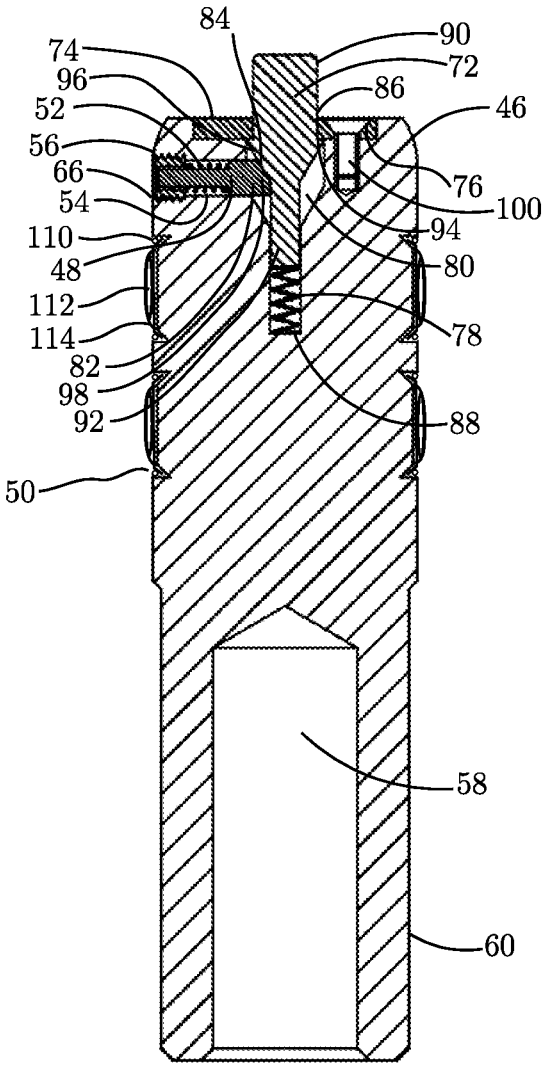
FIG. 7 is a cross-sectional view of the connector with the locking pin at unplugged position according to the second embodiment of the present invention.

FIG. 7 shows a connector 26 of the second embodiment at its unplugged position (i.e. before the mandril 72 engages an interior roof of the recess 36). The connector 26 has a housing that is substantially in cylindrical shape. The connector 26 includes the locking pin 48 disposed radially at the head portion 46 of the housing. The locking pin 48 is selectively movable from an unlocked position and a locked position. At least a portion of the locking pin 48 is projected from the connector 26 when it is at the locked position. The locking pin 48 is made of aluminum. The surface of the connector 26 has a plurality of recesses 50. The connector 26 further comprises a plurality of multi contact rings 114 placed around the surface of the connector 26 and configured to facilitate the transfer of electricity at high power. Each of the multi contact rings 114 comprises a pair of legs at its side edges, which is inserted into the recesses 50 and a flexible cushion 112 disposed on its surface between the side edges. A clamping ring 110 is further disposed at each of the recesses 50 and on each of the legs of the multi contact ring 114 for fixing the multi contact ring 114 on the surface of the connector 26. The radius of the multi contact ring 114 at the flexible cushion 112 portion is slightly larger than the radius of the connector 26. When the connector 26 is inserted into the HV electrode 28, the flexible cushion 112 is compressed by the wall of the HV electrode 28 and the surface wall of the connector 26, thereby an electric connection between the connector 26 and the HV electrode 28 is secured through the multi contact rings 114. With the plurality of multi contact rings 114 used over the recesses 50, the cable termination 20 can transfer electricity at 3700 A or more from the power cable 24 to the HV electrode 28 through the connector 26. The multi contact rings 114 also ensure a good conductivity or to allow a smooth current flow. The connector 26 includes a cable cavity 58 at the cable end 60 for receiving and connecting the power cable 24. At the head portion 46 of the connector 26, a locking pin cavity 54 is formed. The locking pin cavity 54 is positioned along an engagement axis that is perpendicularly to the insertion axis of the connector 26. Inside the locking pin cavity 54 includes the locking pin 48, a locking pin stopper 56 and a locking pin spring 52. The locking pin stopper 56 is a hollow threaded screw unit. The head portion 46 of the connector 26 further includes a mandril cavity 80 positioned along the insertion axis of the connector 26.

The locking pin cavity 54 has a diameter to fitly accommodate the locking pin spring 52, the locking pin 48 and the locking pin stopper 56. The locking pin stopper 56 and the locking pin spring 52 are disposed around the locking pin 48. The locking pin stopper 56 is installed in the opening end 66 of the locking pin cavity 54, where the opening end 66 is located at the connector's outer surface. The locking pin 48 includes a pin with an enlarged box-like head 82 at one end. The enlarged box-like head 82 of the locking pin 48 is substantially in box-like shape with one inclined portion 84. At least one side of the enlarged box-like head 82 is larger than the diameter of the pin which is in cylindrical shape. The locking pin spring 52 is installed between the locking pin stopper 56 and the enlarged box-like head 82. Also at least one side of the enlarged box-like head 82 is substantially larger than the diameter of the locking pin stopper 56 such that when the locking pin 48 is pushed out by the mandril 72, only a portion of the pin is extended out of the connector 26 as the enlarged box-like head 82 is blocked by the locking pin stopper 56 when the locking pin spring 52 pushes the locking pin 48 away from the locking pin cavity 54. The locking pin cavity 54 has a length to hold the whole length of the locking pin 48 when it is retracted into the locking pin cavity 54. The diameter of the projected end of the locking pin 48 is 3.8±0.05 mm while the dimension of one side of the enlarged box-like head 82 of the locking pin 48 is 5.6±0.05 mm.

The mandril cavity 80 includes the mandril 72, a mandril spring 78 disposed at the close end 88 of the mandril cavity 80 and a first mandril stopper 74 and a second mandril stopper 76 at the open end 86 of the mandril cavity 80. The mandril 72 is deposited among the mandril spring 78, the first mandril stopper 74 and the second mandril stopper 76. The mandril 72 has a cylindrical head 90 and a cylindrical tail 92. The diameter of the cylindrical head 90 is larger than the diameter of the cylindrical tail 92. The mandril 72 further includes a fringe 94 extended from the surface of the cylindrical head 90. An inclined surface 96 (as an intermediate portion) is formed/connected between the fringe 94 and the cylindrical tail 92 of the mandril 72. The cylindrical head 90 of the mandril 72 is extended away from the mandril cavity 80 at the open end 86 of the mandril cavity 80. The fringe 94 and the cylindrical tail 92 are disposed within the mandril cavity 80. The mandril 72 is supported by the mandril spring 78 at the cylindrical tail 92. At the unplugged position, the first mandril stopper 74 and the second mandril stopper 76 capture the fringe 94 of the mandril 72 as the mandril 72 is pushed by the mandril spring 78 at the cylindrical tail 92 of the mandril 72. As a result, the mandril 72 is held in the mandril cavity 80. Further, the mandril cavity 80 includes an interactive portion 98 located at one side of the mandril cavity 80 and the second end of the locking pin cavity 54, which is opposite to the opening end 66. The interactive portion 98 provides a space for the mandril 72 to interact/actuate the locking pin 48. At the pre-enegement position also provides a space for the locking pin 48 to stay in the unlocked position. The inclined surface 96 of the mandril 72 is fitly in contact with the inclined portion 84 of the locking pin 48 at the unplugged position. The mandril 72 is movably positioned along the insertion axis of the connector 26 and configured to exert a force along the engagement axis that is perpendicular to the insertion axis of the connector 26 to the locking pin 48 at the inclined portion 84 of the enlarged box-like head 82 thereof at the interactive portion 98. The first mandril stopper 74 is substantially in disk shape and the second mandril stopper 76 is substantially in circular shape. At least a portion of the first mandril stopper 74 and the second mandril stopper 76 cover the open end 86 of the mandril cavity 80. At least a portion of the second mandril stopper 76 is on a boss hole 100, which is next to the mandril cavity 80.

Figure 8:
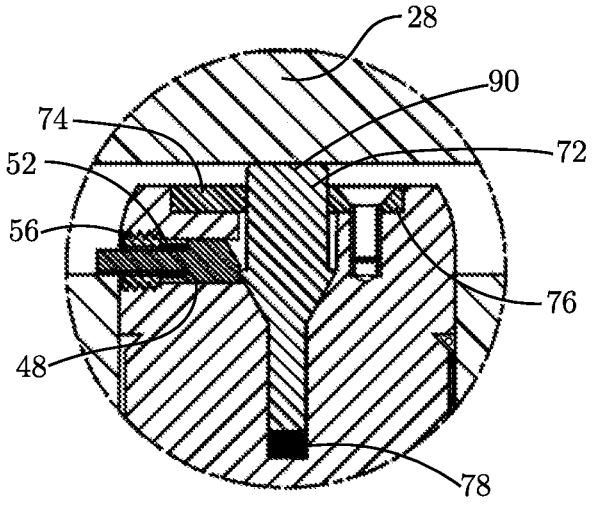
FIG. 8 is a cross-sectional view of the connector with the locking pin at plugged in position according to the second embodiment of the present invention.

FIG. 8 shows the connector 26 at plugged in position. At the plugged in position, the cylindrical head 90 of the mandril 72 engages an interior roof of the recess 36 of the HV electrode 28 as the connector 26 is inserted into the HV electrode 28. The recess 36 is configured to receive the head portion 46 of the connector 26 with the locking pin 48 as the connector 26 is inserted into the hollow portion 30 of the HV electrode 28. The connector 26 is optionally connected to the power cable 24 at the tail end 60 during the insertion. As the head portion 46 of the connector 26 approaches the recess 36, the wall of the recess 36 presses against the mandril 72, which pushes the mandril 72 into the mandril cavity 80. The mandril spring 78 is compressed by the cylindrical tail 92 of the mandril 72 in this process. As the mandril 72 retracts into the mandril cavity 80, the fringe 94 and the inclined surface 96 of the mandril 72 pushes the locking pin 48 away from the locking pin cavity 54 at the inclined portion 84. As a result, the locking pin 48 is push radially away from the center of the connector 26 such that it protrudes outside the exterior surface of the connector and towards the recess 36 thereby becomes inserted therein. As a result, the pin attaches to a wall 70 of the recess 36, which is adjacent to the projected portion of the locking pin 48. When at the engagement position, the inclined surface is configured to push the locking pin 48 into the locked position and the fringe is anchored by the enlarged box-like head of the locking pin 48 such that the mandril 92 is held at the engagement position and said locking pin 48 is held at said locked position. Thus, the position of the power cable 24 is fixed. It can be seen that the end of the locking pin 48 is enlarged to ensure that it holds the power cable tightly.

Accordingly, the present invention provides a high voltage plug-in and unplugged type gas immersed cable termination with a locking system holding the power cable tightly enough without loosening during fault conditions or vibrations over the years on load or due to the heavy conductor and insulation loading.

When unlocking the connector 26 from the electrode 28, the power cable 24 and the connector 26 are pulled away from the HV electrode 28 with sufficient force in order to wreck the projected portion of the locking pin 48. There is no disengagement position for the mandril 72 is introduced. Thus, it is possible for the power cable 24 to be removed manually directly from the engagement position without disturbing the major components of the cable termination 20.

The locking pin 48 can be broken by screwing the termination at the bottom of the compression unit during the unplugging operation. Then the power cable can be removed whenever necessary.

The locking pin 48 can be replaced when plug-in operation is necessary again after un-plugging.

In one exemplary embodiment, the length of the locking pin 48 is 18.9±0.1 mm while the length of the enlarged head 68 of the locking pin 48 in the axis direction is 7.0±0.1 mm. One side of the enlarge head 68 of the locking pin 48 according to the second embodiment is 5.9±0.05 mm while the diameter of the projected end of the locking pin 48 is 3.0±0.05 mm.

Accordingly, the diameter of the locking pin cavity 54 is 6.0±0.1 mm.

In one exemplary embodiment, the diameter of the cylindrical head 90 of the mandril 72 is 10.8±0.1 mm. The external diameter of the fringe 94 of the mandril 72 is 12.8±0.1 mm the diameter of the cylindrical tail 92 of the mandril 72 is 4.9±0.05 mm. The length of the mandril 72 is 36.0±0.1 mm while the length of the cylindrical tail 92 is 14.4±0.1 mm. The length of the inclined surface 96 is 6.8±0.1 mm while the length of the fringe 94 in the axis direction is 0.5±0.1 mm. The inclined surface 96 is 30° from the insertion axis of the mandril 72. The mandril 72 is made of stainless steel.

Accordingly, the diameter of the open end 86 of the mandril cavity 80 is 13±0.1 mm while the diameter of the close end 88 of the mandril cavity 80 is 5.0±0.1 mm. The length of the mandril cavity 80 is 36.5±0 5 mm while the length of the cylindrical portion with enlarged diameter is 11.7±0.1 mm. The inclined surface 96 thereof is 30° from the insertion axis of the mandril cavity 80.

In one embodiment, the length of the locking pin cavity 54 is as same as the diameter of the connector 26. Each of the two open ends at the connector's surface comprises the locking pin stopper 56. In another embodiment, first mandril stopper and the second mandrial stopper are substantially in circular shape. At least a portion of the first mandril stopper and the second mandril stopper cover the open end 86 of the mandril cavity 80. At least a portion of the first and second mandril stopper is on a boss hole, which is next to the mandril cavity 80.

In one embodiment, there are more than one locking pin. In another embodiment, the locking pin cavity 54 is positioned along an engagement axis that is perpendicularly to the insertion axis of the connector 26. In yet another embodiment, the locking pin the mandril 72 is movably positioned along the insertion axis of the connector 26 and configured to exert a force that is perpendicular to the insertion axis of the connector 26 to the locking pin 48 at the inclined portion 84 of the enlarged box-like head 82 thereof at the interactive portion 98.

The exemplary embodiments of the present invention are thus fully described. Although the description referred to particular embodiments, it will be clear to one skilled in the art that the present invention may be practiced with variation of these specific details. Hence this invention should not be construed as limited to the embodiments set forth herein.

What is claimed is:

1. A system for positioning a power cable comprising a connector, wherein said connector comprising i. a housing comprising a cable end and an opposing engagement end defining an insertion axis therebetween;

ii. a cable cavity disposed on said cable end and configured to receive said power cable;

iii. an actuator placed at said housing at said engagement end and movable along said insertion axis towards said cable end; said actuator movable between a pre-engagement position and an engagement position;

iv. at least one locking pin provided within said housing and movable along an engagement axis axial to said insertion axis; said locking pin engaged to said actuator and movable from an unlocked to a locked position;

wherein said actuator in said pre-engagement position provides a space for said locking pin to stay in said unlocked position; said actuator in said engagement position pushes said locking pin into said locked position and is anchored by said locking pin such that said power cable is electrically connected to said electrode.

2. The system according to claim 1, wherein said connector further comprises a locking pin cavity positioned along said engagement axis, wherein said locking pin cavity further comprises a locking pin stopper and a locking pin spring disposed around said locking pin, and wherein said locking pin is movably disposed within said locking pin cavity, and when said locking pin is at said second locked position at least a portion of said locking pin is extended out of said locking pin cavity.

3. The system according to claim 2, wherein said locking pin stopper further comprises a hollow threaded screw unit.

4. The system according to claim 2, wherein said locking pin stopper is configured to fix said locking pin on said insertion axis.

5. The system according to claim 1, wherein said actuator is a mandril.

6. The system according to claim 5, wherein said mandril has a head and a narrower tail.

7. The system according to claim 5, wherein said connector further comprises a mandril cavity positioned along said insertion axis, wherein said mandril is movably disposed within said mandril cavity and is configured to push said locking pin at one end thereof.

8. The system according to claim 6, wherein said mandril cavity further comprises a mandril spring disposed at one end of said mandril cavity and a plurality of mandril stoppers at the other end of said mandril cavity, wherein said mandril is deposited between said mandril spring and said plurality of mandril stopper while at least a portion of mandril is extended outside the mandril cavity.

9. The system according to claim 7, wherein said mandril further comprises i. an intermediate portion disposed between said head and said narrower tail of said mandril; and ii. a fringe extended outwardly from said head of said mandril and disposed between said head and said intermediate portion wherein said intermediate portion comprises an inclined surface connecting between said narrower tail and said fringe, when at said engagement position, said inclined surface is configured to push said locking pin into said locked position and said fringe is anchored by said one end of said locking pin such that said mandril is held at said engagement position and said locking pin is held at said locked position.

10. The system according to claim 7, wherein said mandril further comprises a fringe extended outwardly configured to be captured by said plurality of mandril stoppers when said mandril is at said pre-engagement position.

11. The system according to claim 1, wherein said connector has recesses on its cylindrical exterior.

12. The system according to claim 1 further comprising an electrode, which comprises a recess positioned near the blind end of said electrode, wherein at least a portion of the electrode is covered by an epoxy resin insulating cone.

13. The system according to claim 1, wherein said locking pin is made of aluminum alloy.

* * * * *